US009272170B2

(12) United States Patent
Hubbell, Jr.

(10) Patent No.: US 9,272,170 B2
(45) Date of Patent: Mar. 1, 2016

(54) FIRE EXTINGUISHING SYSTEM TO ELIMINATE SMOLDERING/SMOKING OF DECOMPOSED DRIED, FORMER MARSHLAND, NOW PEAT, SURROUNDED BY WATER

(71) Applicant: Paul Joseph Hubbell, Jr., Metairie, LA (US)

(72) Inventor: Paul Joseph Hubbell, Jr., Metairie, LA (US)

( * ) Notice: Subject to any disclaimer, the term of this patent is extended or adjusted under 35 U.S.C. 154(b) by 649 days.

(21) Appl. No.: 13/573,567

(22) Filed: Sep. 25, 2012

(65) Prior Publication Data

US 2014/0083724 A1 Mar. 27, 2014

(51) Int. Cl.
*A62C 29/00* (2006.01)

(52) U.S. Cl.
CPC ..... *A62C 29/00* (2013.01)

(58) Field of Classification Search
CPC ..... A62C 29/00
USPC ..... 169/52, 46–47, 62, 67–68, 30
See application file for complete search history.

(56) References Cited

U.S. PATENT DOCUMENTS

| | | | | |
|---|---|---|---|---|
| 2,023,028 | A * | 12/1935 | Offerdahl | 169/70 |
| 3,339,516 | A * | 9/1967 | Lenci | 440/39 |
| 4,290,379 | A * | 9/1981 | Carter | 114/26 |
| 4,390,315 | A * | 6/1983 | Elliston | 414/740 |
| 5,624,238 | A * | 4/1997 | Herbert | 417/61 |
| 6,269,763 | B1 * | 8/2001 | Woodland | 114/382 |
| 2014/0076227 | A1 * | 3/2014 | Saccenti | 114/343 |

* cited by examiner

*Primary Examiner* — Ryan Reis
*Assistant Examiner* — Chee-Chong Lee

(57) ABSTRACT

A firefighting method and apparatus are described for suppressing fires in remote dried out former wetlands/marsh areas. A water pump is positioned upon a floating platform maneuverable in adjacent shallow marsh waters that are not navigable by conventional watercraft. Said pump has an intake port for drawing water from nearby marsh waters and ponds through a hose, said hose having a filtering screen for preventing the pickup of solid materials. The pump has a discharge hose connected to the outflow connection, said discharge hose connected on the distal end to a piping extension projecting away from the hull and over the nearby burning peat lands. Said pump is operated to discharge water over and into the adjacent burning marsh as the platform is maneuvered within the surrounding marsh canals and waterways.

20 Claims, 7 Drawing Sheets

WATER CANNON

HIGH PRESSURE NOZZLE

LOW PRESSURE NOZZLE

FIRE EXTINGUISHING SYSTEM TO ELIMINATE SMOLDERING/SMOKING OF DECOMPOSED DRIED, FORMER MARSHLAND, NOW PEAT, SURROUNDED BY WATER

REFERENCE TO RELATED DISCLOSURE

The present Utility patent application includes and refers to the Provisional Patent Application No. 61/626,446 filed on Sep. 27, 2011; titled fire Extinguishing System to Eliminate Smoldering/Smoking Of Decomposed Dried Former Marshland, Now Peat, Surrounded By Water

TECHNICAL FIELD

An incident in eastern New Orleans, recently, a fire of unknown origin, possibly lightning, had been burning for almost a month in an inaccessible acreage to conventional fire fighting equipment, following a drought, succeeded by a tropical storm, LEE, with heavy rainfall to no avail while the fire/smoldered underground with the sole source of fire fighting being done by National Guard helicopters with their "dipping" 500 gallon baskets at $2,000 per hour. No totals available on the daily hours spent during the many days during that span of almost a month.

There are some canals, ditches, a lake, some ponds of the former surrounding wetlands that surround these many acres between two highways: 90 and I-10. The helicopters didn't start fighting the fires for several days until the acrid smoke began moving into the entire New Orleans metro area which includes several other parishes, including Baton Rouge, 80 miles away.

This smoke became a health hazard for many in residential, commercial buildings, particularly hospitals, surgery centers and nursing homes. With federal, state and local building codes requiring "fresh" outside air for HVAC systems, the impact was felt severely in those facilities as well as many residences, especially those older ones with leaking window frames, which in many cases, the smoke entered and in others the smell as well which affected the respiratory systems of many along with irritated eyes etc.

In years past, with the right weather conditions, fog and fire was classified as Smog. This smog contributed to a 40 car pile up, many injuries and two deaths on I-10 East.

A possible alternative solution is the following invention with accompanying drawings and First Preferred Embodiment:

Utilizing shallow draft aluminum or equal flat hulls/boats or mini barges to navigate the adjacent canals, bayou's, ditches and or lakes similar to ones used to fish and/or work the shallow shorelines of the wetlands to position locations surrounding the smoldering ground fires and extinguish same with the following methods:

MODES OF OPERATION

The bow of the vessel mounted with a portable crane for lifting the equipment required such as a diesel engine driven pump, heavy duty water hoses/accessories a protective cage assembly to position the intake suction hose above the bottom, water floor, with mud/silt baffles to prevent the intake of mud/debris/silt, while at the same time preventing aquatic species such as crabs, shrimp and fish from entering the pump suction.

The pump is available in the commercial market and can be selected from a variety of performance ranges as well as all the accessories which include flexible commercial hoses/couplings along with optional fire hoses and/or PVC or other pipe types.

The pump is mounted near the front of the vessel behind the crane along with an approved fuel tank.

The pump is connected to the intake source piping and also to the discharge piping of either fire hose coupled PVC or other selected rigid piping that extends into the smoldering/dry marsh peat land for a pre-selected desired distance to flood and saturate the area with 24/7 water flow that will seep into the subsurface below. This method can be strategically selected to attack from multiple vantage points to center in on the problem and extinguish same with saturation/water.

The vessels can be refueled with a similar service design type boat with fuel tank capacities to maintain around the clock provision.

Marsh Buggy's or other means can be utilized to distribute and position the discharge piping for the most comprehensive and effective flow.

An alternative option would be to require water wells to be installed in these vulnerable areas, especially, privately owned parcels.

A Second Preferred Embodiment which is illustrated in drawing No. 3 is one that utilizes and incorporates the use of a water cannon. This water cannon, mounted to the deck of the vessel, adjacent to the pump that siphons water supply would provide controlled spraying with adjustable nozzle pressure and would provide additional options to fight and control buildings/structures fires, such as camps/homes, located in the remote areas of wetlands, that are inaccessible to conventional fire fighting equipment.

In certain situations the water cannon of the Second Preferred Embodiment could also be employed to penetrate some of the decomposed areas of peat lands, if needed.

A third preferred embodiment includes a second pump for high pressure, mounted adjacent to the first, low pressure pump, and closer to the stern with its inlet, As shown in FIG. 1B, HPP#2 is connected to a common inlet with LPP #1 and the larger discharge pipe of LPP#1 houses the discharge line of HPP #2 internally, parallel, with separate/dual distal end outlets at the point of the target attack area of the underground fire. An additional option of the third preferred embodiment as shown in FIG. 1 C, HPP#2 mounted on a remote skid closer to the target area, when feasible, and with its intake/supply line connected and controlled with a ball valve and its discharge outlet, hose with nozzle, available for multiple positions to open the sub surface ground to allow low pressure flow from pump #1 to flood the cavity and extinguish the peat fire.

BACKGROUND/PRIOR ART

Preliminary searches for comparable art that includes very shallow draft boats with "V" hulls and flat deck that can navigate the depths encountered in the problem areas of non-navigable waterways, revealed none. All discovered, whether private or governmental types were: too much draft, heavy duty, weight, beam, length and engine HP plus costs. All were designed for deep water channels, oceans, harbors and other waterways. These included Fire and Patrol Boats. Supplemental pictures and specifications of some of these are attached.

Therefore, the custom made WORKSKIFF selected, with its specifications, flexibility and size modifications with accessories included in addition to being GSA approved, would allow for appropriate downsizing to a 21 foot length, weight and cost to facilitate the object and purpose of the proposed system incorporated to satisfy the desired results. Pumping capacities, hose/pipe sizes to be engineered and designed for various installations/uses.

Additional benefits of this invention; allows for governmental agencies, local, state and federal levels to incorporate these systems into their fire prevention schemes which could result in enhanced possibilities for safety, insurance coverage/rates as well as benefits for human health and the environment.

Includes added identifiers: (IH): Intake Hose and (LPN); {Inset}, attached to the (WDH); Water Discharge Hose.

Figure 1:
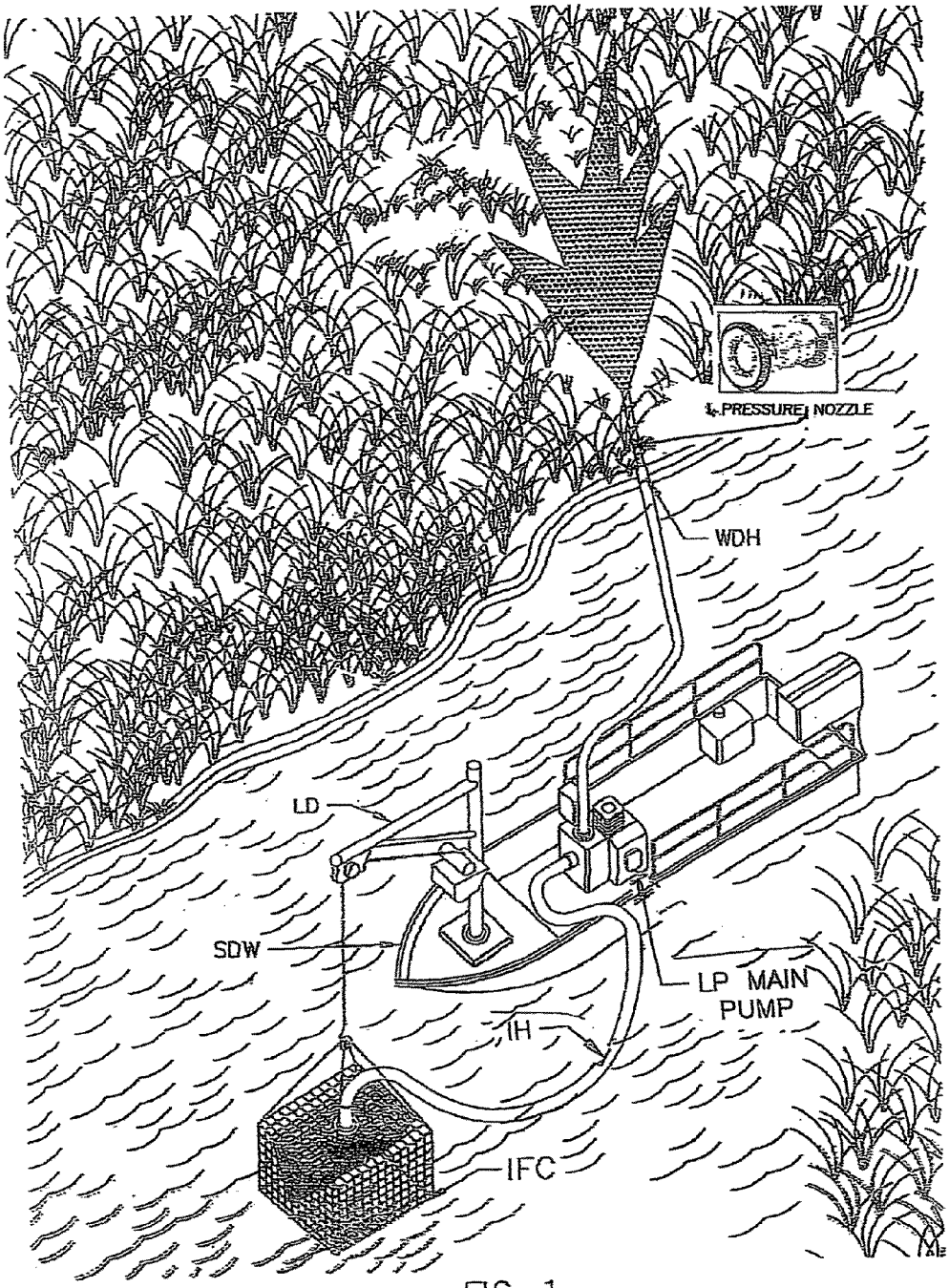
FIG. 1 Displays the First Preferred Embodiment of a shallow "V" shaped, flat deck, Aluminum hull positioned to induce water from a shallow canal or body of water, adjacent to former wetlands, now dry peat and inaccessible to conventional fire fighting equipment and/or fire boats and through its on board pumping system, provide spray and outflow/discharge water to fight and "extinguish the intense and underground fires".
Figure 1A:
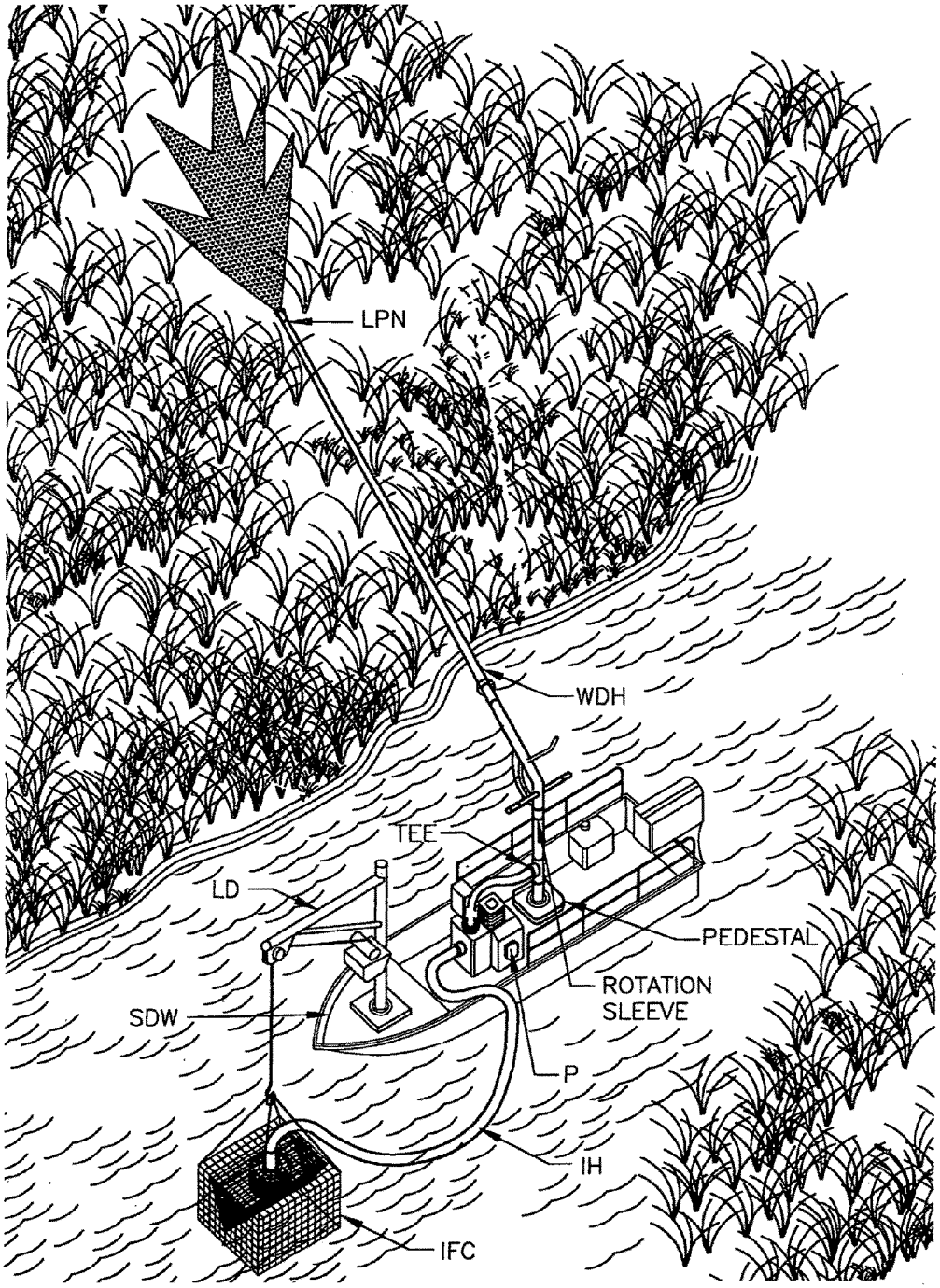

FIG. 1A Illustrates the option to provide additional extended hose/pipe lines at further distances into the Peat land, laid atop the ground level surface to flow low pressure, high volume, water into the depths of the fire source, in an attempt to flood out same.

Includes and Displays the LP Pump Discharge into a Tee connection of the vertically deck mounted Pedestal with a Rotation Sleeve, connected to an angular Discharge pipe that connects into a Tee connection of the vertically deck mounted pedestal which connects to a Pipe/Hose Adapter for extensions/options of distance with an LPN mounted at the distal end.

Figure 1B:
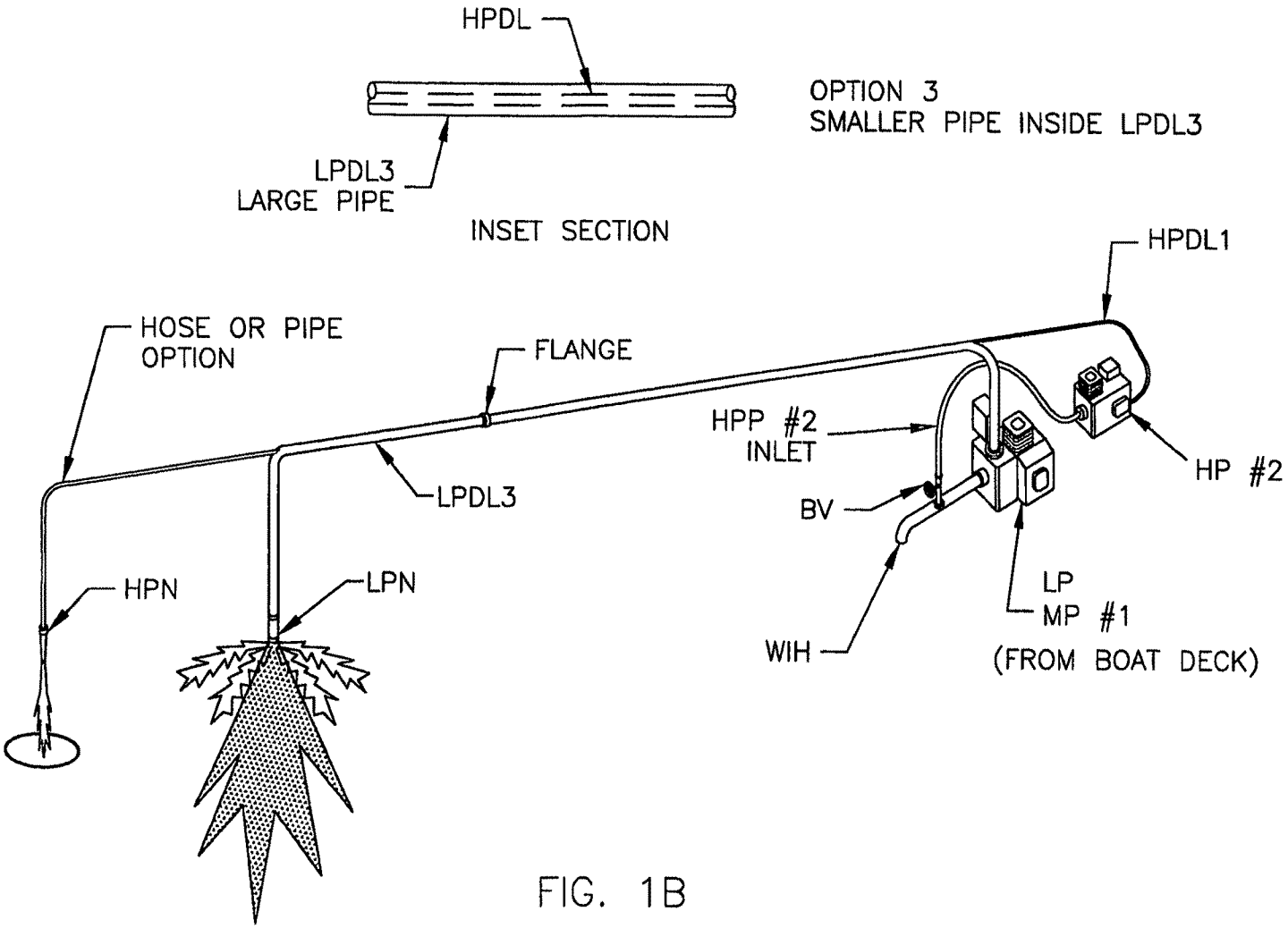

FIG. 1B Depicts the Second Preferred Embodiment which illustrates the #1 (LP) Main Pump whose Intake hose (IR) supplies the Discharge (LP)/High Volume larger Hose/Pipe option to flood a desired area while at the same time provides a smaller (HP) pipe/hose option inserted into the larger, conduit (LP) line, internally/laterally supplied from a (HP) Discharge line of Pump #2 whose intake is fed/supplied from the (WIH) of the #1 (LP) Main pump and has a (BV) Ball Valve for throttling, thus allowing the (HP) hose/pipe nozzle to penetrate into the deeper depths below the surface where the source and higher temperatures emanate, thereby, providing the option to flood the cavity created by the (HP) Discharge) with the additional (LP), High Volume line (LPDL3)

and accelerate the extinguishing process.

Figure 1C:
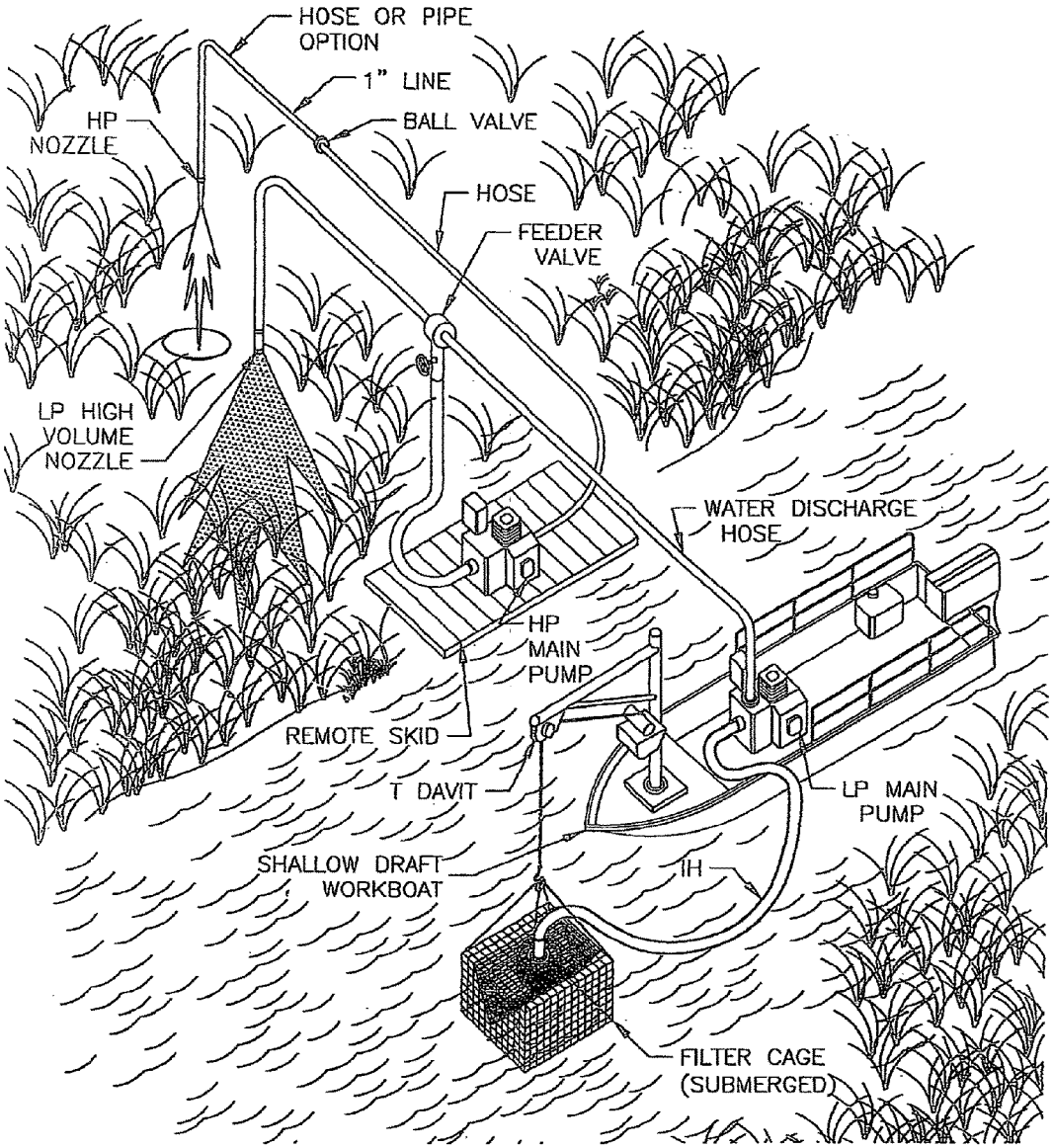

FIG. 1C: Illustrates the two pump systems wherein the high pressure main Pump (HPMP) is mounted on a skid remotely, but closer to the target area when feasible, for crews or other means, such as Marsh Buggy's can navigate the landscape and whose intake is supplied through a feeder, make up, valve connected to the Discharge line of the primary low pressure (LP) main pump system. These two (LP) and (HP) pump systems can be operated individually and/or in tandem, simultaneously wherein the feeder valve and discharge Ball Valve provide the options for desired methods of operation. Also included are the options to connect from the respective control valves of the (LP) and (HP) terminal sections with either pipe and/or hose at the distal ends that contain the respective nozzles for each.

Figure 2:
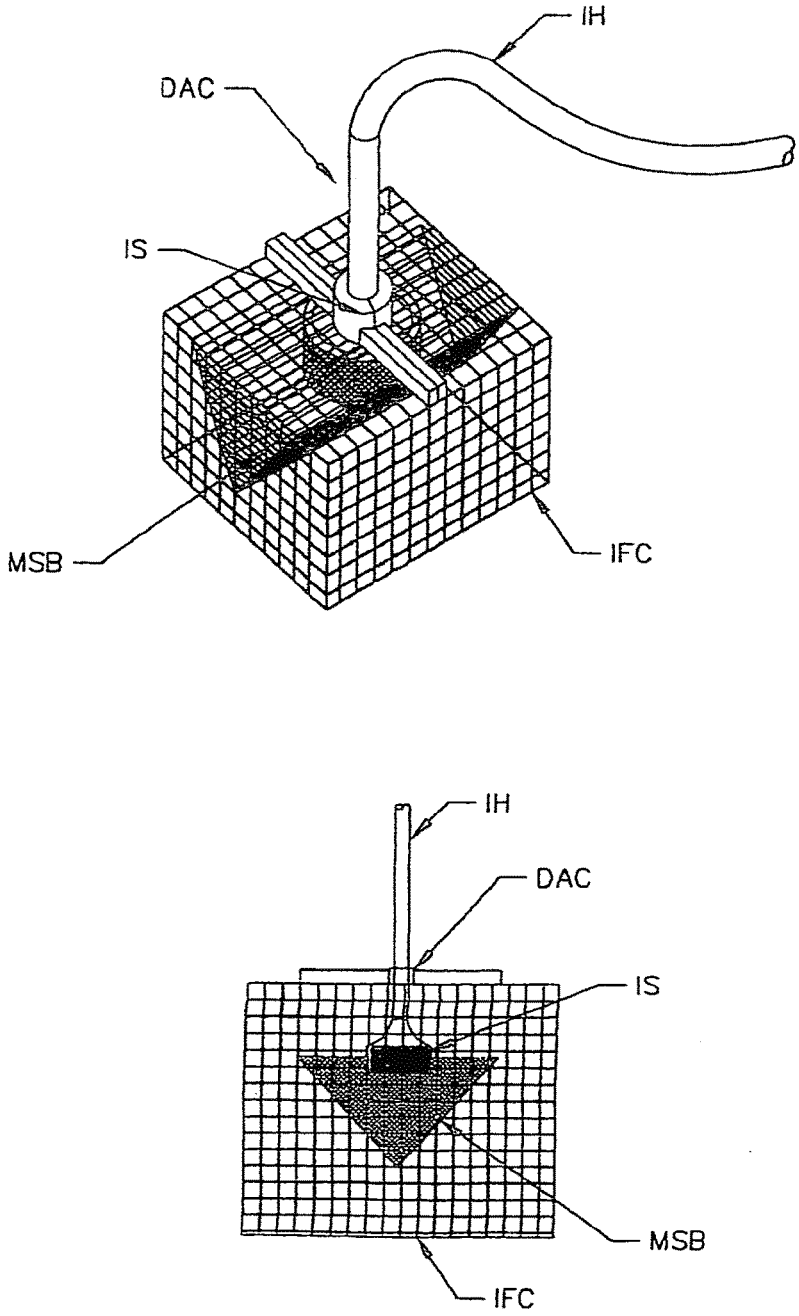

FIG. 2: Details the water intake, pump supply, mechanism which includes a steel wire protective cage and contains a mud/silt baffle, strainer and a adjustable clamp for depth variation of the intake hose (IH)/pipe that connects to the (LP) pump inlet.

Figure 3:
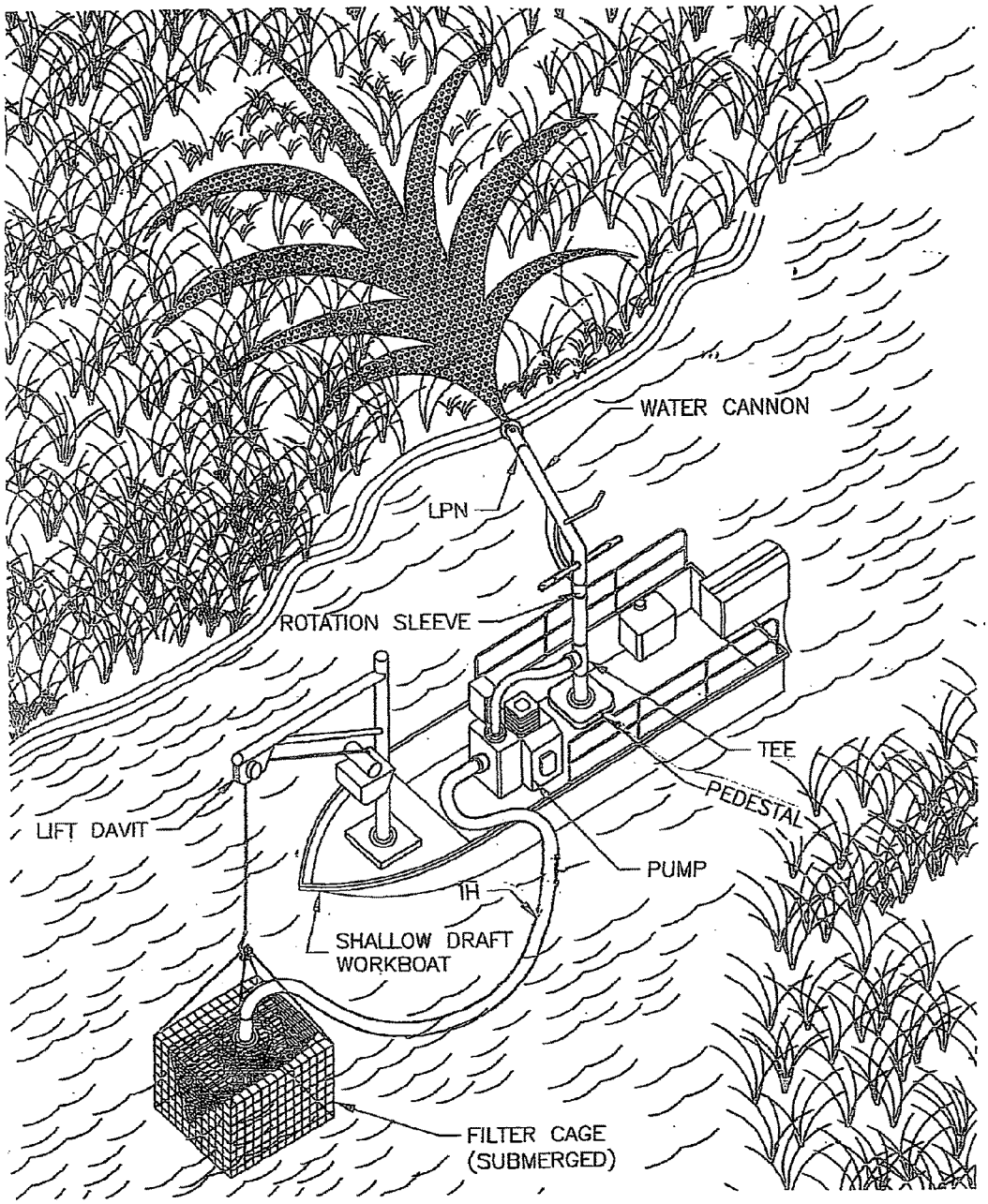

FIG. 3 Shows the first Preferred Embodiment utilizing a WATER CANNON with Nozzle to spray areas, including above the ground structures such as isolated camps or other remote objects requiring extinguishing.

Figure 4:
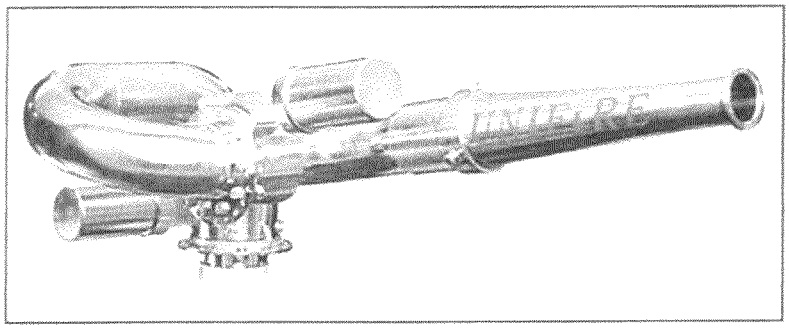
Figure 4:
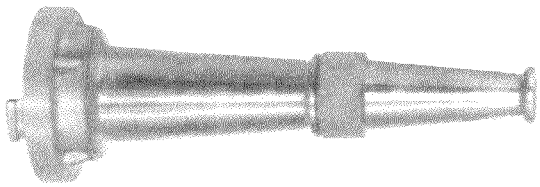
Figure 4:
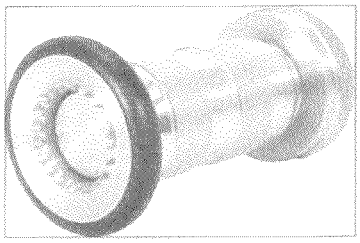

FIG. 4: Illustrates the various nozzles, such as; WATER CANNON; (HPN) HIGH PRESSURE NOZZLE and (LPN) LOW PRESSURE NOZZLES that are incorporated into the various options methods.

The invention claimed is:

1. A floating vessel for fighting and extinguishing fires, said vessel maneuverable in shallow marsh and shoreline waters that are difficult to access by land or sea, consisting of;

a buoyant hull with a lift davit mounted thereon;

said hull containing a low pressure, high volume water pump with intake and discharge ports thereon;

an intake hose connected to a suction port of the water pump, said intake hose having a distal end with an opening submerged below the water level in which the hull is floating;

a water cannon connected to a outflow connection of the water pump, a discharge hose connected to the outflow connection of the water pump, said discharge hose connected on the distal end to a piping extension projecting away from the hull;

said piping extension lying above the marsh shoreline surface and carrying a stream of water to a location of the fire to be extinguished.

2. The vessel of claim 1 wherein the hull is "v" shaped.

3. The vessel of claim 2 wherein the hull is self-propelled and steered by an operator.

4. The vessel of claim 2 wherein the hull is towed or pushed by another vessel or vehicle.

5. The vessel of claim 2 wherein the opening of the distal end of the intake hose has a wire mesh screen to prevent solid materials from entering the intake hose.

6. The vessel of claim 2 wherein a terminal end of the piping extension is the water cannon which has an adjustable nozzle for forming a spray when the water is delivered.

7. The vessel of claim 1 has a flat deck.

8. The vessel of claim 7 wherein the hull is self-propelled and steered by an operator.

9. The vessel of claim 7 is towed or pushed to location by another vessel or vehicle.

10. The vessel of claim 7 wherein the opening of the distal end of the intake hose has a wire mesh screen to prevent solid materials from entering the intake hose.

11. The vessel of claim 7 wherein a terminal end of the piping extension is the water cannon which has an adjustable nozzle for forming a spray when the water is delivered.

12. A floating vessel for fighting and extinguishing fires, said vessel maneuverable in shallow marsh and shoreline waters that are difficult to access by land or sea, and consisting of;

a buoyant hull with a lift davit mounted thereon;

said hull containing a high pressure, high volume water pump with intake and discharge ports thereon;

an intake hose connected to a suction port of the water pump, an intake having a distal end with an opening submerged below the water level in which the hull is floating;

the discharge port connected to a water diffusing nozzle projecting water into the area of the fire away from the hull.

13. The vessel of claim 12 wherein the hull is "V" shaped.

14. The vessel of claim 12 wherein the hull is self-propelled and steered by an operator.

15. The vessel of claim 12 wherein the hull is towed or pushed by another vessel or vehicle.

16. The vessel of claim 12 wherein the opening at the distal end of the intake hose has a wire mesh screen to prevent solid materials from entering the intake hose.

17. The vessel of claim 12 wherein the hull has a flat deck.

18. The vessel of claim 12 wherein the hull is self-propelled and steered by an operator.

19. The vessel of claim 12 wherein the hull is towed or pushed to another vessel or vehicle.

20. The vessel of claim 12 wherein the opening at the distal end of the intake hose has a wire mesh screen to prevent solid materials from entering the intake hose.

* * * * *